United States Patent [19]

Tsuji et al.

[11] Patent Number: 4,728,221

[45] Date of Patent: Mar. 1, 1988

[54] FLEXIBLE MEMBRANE DAM

[75] Inventors: Yoshiomi Tsuji; Ichiro Maruyama; Haruhiko Matsuoka, all of Osaka, Japan

[73] Assignee: Sumitomo Electric Industries, Ltd., Osaka, Japan

[21] Appl. No.: 915,572

[22] Filed: Oct. 6, 1986

Related U.S. Application Data

[63] Continuation-in-part of Ser. No. 818,752, Jan. 14, 1986, abandoned.

[30] Foreign Application Priority Data

Jan. 19, 1985 [JP] Japan ..... 60-7866

[51] Int. Cl.[4] ..... E02B 7/02

[52] U.S. Cl. ..... 405/115; 405/91; 405/92

[58] Field of Search ..... 405/87, 90–92, 405/96, 97, 98, 107, 115

[56] References Cited

U.S. PATENT DOCUMENTS

| | | | |
|---|---|---|---|
| 4,330,224 | 5/1982 | Maramatsu et al. | 405/115 |
| 4,498,810 | 12/1985 | Maramatsu et al. | 405/115 |

FOREIGN PATENT DOCUMENTS

| | | | |
|---|---|---|---|
| 11702 | 6/1964 | Japan . | |
| 2371 | 1/1969 | Japan . | |
| 17075 | 5/1973 | Japan . | |
| 79928 | 6/1979 | Japan . | |
| 12410 | 2/1981 | Japan | 405/92 |
| 133916 | 8/1982 | Japan | 405/115 |
| 209313 | 12/1982 | Japan | 405/115 |
| 176310 | 10/1983 | Japan | 405/92 |
| 1602335 | 11/1981 | United Kingdom . | |

*Primary Examiner*—Nancy J. Stodola

*Attorney, Agent, or Firm*—Cushman, Darby & Cushman

[57] ABSTRACT

An inflatable and collapsible dam arrangement including a flexible membrane weir element positioned so that when it is inflated, it will block a flow of water. The control chamber for the weir is divided into upper and lower sections. The upper section has at least a portion above ground and contains an apparatus for inflating the dam and making the weir element self-supporting. The lower control section includes at least a portion positioned underground and includes an apparatus for collapsing the dam.

4 Claims, 7 Drawing Figures

FLEXIBLE MEMBRANE DAM

CROSS-REFERENCE TO RELATED APPLICATION

This application is a continuation-in-part of Ser. No. 818,752, filed Jan. 14, 1986, now abandoned.

BACKGROUND OF THE INVENTION

1. Field of Invention

This invention relates in general to dam arrangements for controlling water flow. More particularly, the invention relates to dam arrangements of the type that include an inflatable and collapsible member, such as, for example, a flexible membrane. Even more specifically, the invention is directed to the control chamber arrangement for controlling the inflating and collapsing of the flexible membrane.

2. Description of The Prior or Related Art

Conventional inflatable and collapsible dams utilize a flexible membrane member formed as an envelope or bag to serve as the weir of the dam. This flexible membrane is generally coated with rubber at least over those portions of the membrane that would be in contact with the water. To inflate the flexible member, a pressure medium such as, for example, air and/or water is pumped into the interior of the member. Sufficient pressure is built up in the envelope to make it self supporting.

To collapse the membrane bag, the pressure medium is discharged from the interior of the flexible member and it contracts. As an example of a conventional inflatable and collapsible dam of this type, see Japanese Patent Publications Nos. 11702/65 and 2371/69.

Conventional inflatable and collapsible dams of the flexible membrane type include a control chamber positioned generally as shown in either FIGS. 1(A) and 1(B) or as shown in FIGS. 2(A) and 2(B) (all prior art). As shown in these figures, a conventional control chamber 50 includes an upper section which projects above the ground and a lower section that is buried underground. The upper and lower sections together constitute a single unit into which all control mechanisms for operating the dam are incorporated.

In FIG. 1(A) (prior art), there is a weir 24. Conventional control chamber 50 is installed on an embankment 22 of a river. Also shown in FIG. 1A are an upper stream water level sensing pipeline 8 and a feed and exhaust pipeline 10. More of the details of conventional control chamber 50 are shown in FIG. 1(B) (prior art).

Referring to FIG. 1(B) (prior art), there is shown a more detailed diagram of one embodiment of a conventional control chamber 50 of the type used in the FIG. 1(A) construction. Chamber 50 includes an automatic inflater means including a float 51 for sensing water level. Float 51 is responsive to an automatic collapse water level 36. The lower section of the control chamber 50 is positioned at an elevation that is lower than a level at which automatic collapse is effected. A blower 1 draws air into the system through an air filter 54 and forces it into an air delivery pipe 55. Air pressure is indicated by a pressure gauge 56. Forced air flows through a valve 57 and a feed and exhaust pipeline 10 to weir 24. Float 51 actuates a pressure relief valve when the dammed water level reaches an automatic collapse water level 36. Upper stream water level sensing pipe 8 provides a water flow to the chamber 50 in which float 51 is positioned.

FIG. 2(A)(PRIOR ART) shows an alternative conventional dam arrangement. In this arrangement, the lower portion of control chamber 50 is lower in elevation than the lower portion of chamber 50 in the FIG. 1A arrangement.

Referring now to FIG. 2(B), there are shown the construction details of chamber 50 of the FIG. 2(A) (PRIOR ART) embodiment.

A water seal pipe 4 provides an indicator of river water level so as to permit automatic collapse at level 36, an inner pressure sensing pipe 53 and a pressure gauge 3 which displays weir pressure. The conventional arrangements may also include a filter 54 for filtering air blown into the system by blower 1, and an air delivery pipe 55. Control chamber 50 also includes a valve 57, pulley 58, and an automatic flattener means relying on a reservoir bucket 6 (rather than on a float 51 shown in FIG. 1(B)) which is positioned at an elevation that is lower than a level at which a base of weir 24 is positioned. This arrangement permits automatic discharging and draining of weir 24 by feed and exhaust pipeline 10 during flattening or collapsing of the weir 24. There are also a bypass valve 59 and an exhaust valve 160. Water level 52 is at the top of weir 24.

The alternate known control mechanism shown in FIGS. 1(B) and 2(B) (PRIOR ART) are more completely described in Japanese early publication no. (OPI) 79928/79 corresponding to British Patent No. 1,602,335.

To fabricate the collapsible dam as shown in FIGS. 1(A) and 1(B) (prior art), it is necessary to dig or excavate the embankment 22 of the river being dammed at least to a level at which automatic flattening of the weir 24 occurs when the weir 24 and control chamber 50 are piped so that the upper stream water level sensing pipeline 8 is positioned at a level less than that at which automatic flattening of the weir 24 is established. To fabricate the dam as shown in FIGS. 2(A) and 2(B), it is necessary to dig the continuation of the weir 24 and the control chamber 50 to a level of the riverbed for horizontally conducting feed and exhaust pipeline 10 to control chamber 50 under the river bed. If conventional control chamber 50 is positioned in the interior of the embankment 22, it is necessary to dig into the embankment 22 for placing the piping. This excavation involves a jeopardy of flooding during the digging operation and requires a major civil engineering effort.

SUMMARY OF THE INVENTION

In view of the above discussed problems attendant dam construction of the conventional arrangements shown in FIGS. 1(A), 1(B), 2(A) and 2(B) (all prior art), the present invention provides an arrangement that works economically and requires no deep digging of a continuation of the weir while still providing good control of the dam.

The dam arrangement provided by the present invention includes a control chamber that is divided into two parts, namely an upper control chamber and a sealed lower control chamber. The upper control chamber includes a means for rendering the dam self-supporting. The lower control chamber includes means for collapsing the dam. The lower control chamber is separate and distinct from the upper control chamber. More specifically, the upper chamber is placed so as to have at least a portion thereof above ground and well above the estimated high water level. The lower control chamber includes at least a portion positioned underground and closer to the weir than the upper control chamber.

Using such a "split" control chamber arrangement, the construction of the dam is made more simple than the construction required for a conventional dam arrangement. The inventor has realized an advantage in splitting the control chamber into upper and lower portions that can be separated from one another. Only those parts which must be dug deeply are placed underground near the embankment. Thus, there is no need for a massive excavation of the river embankment.

DETAILED DESCRIPTION OF THE PREFERRED EMBODIMENT

Figure 1A:
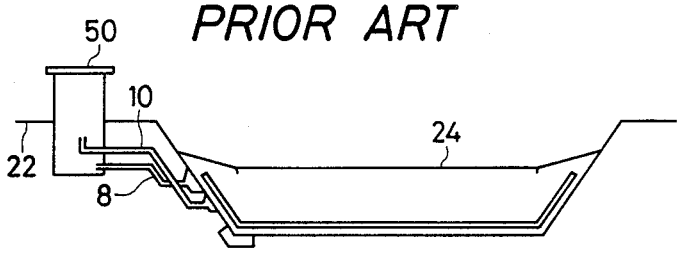
FIG. 1(A) PRIOR ART
FIG. 1(A) (prior art) is a front view of a first embodiment of a conventional dam having an automatic collapsible means for use with a float as viewed from the direction of a stream being dammed.
Figure 1B:
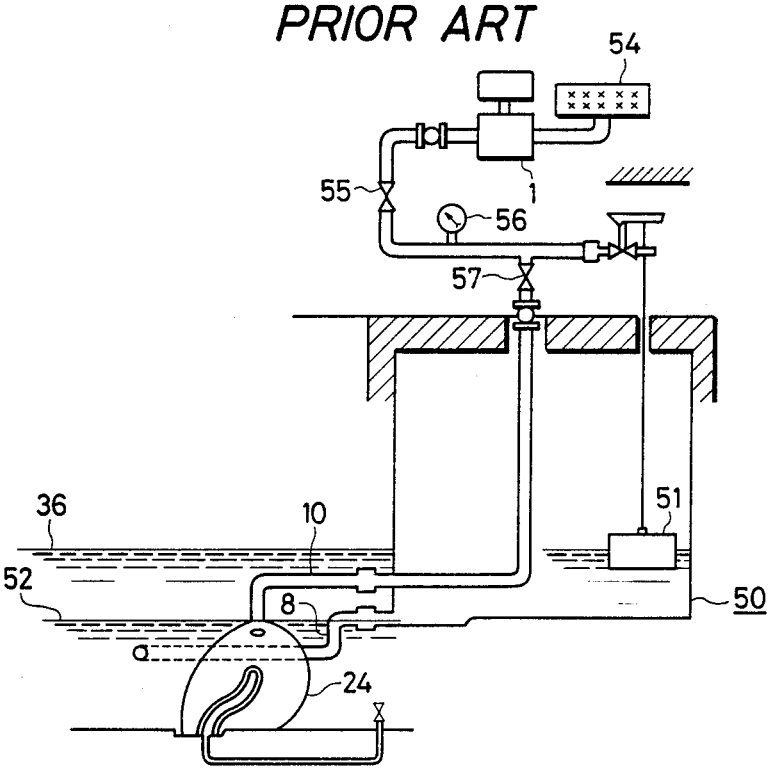
FIG. 1(B) PRIOR ART
FIG. 1(B) (prior art) is a sectional view of the dam shown in FIG. 1.
Figure 2A:
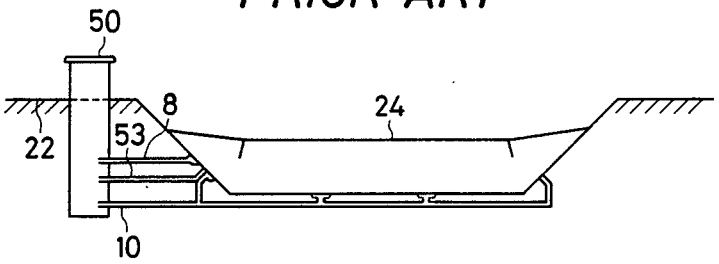
FIG. 2(A) PRIOR ART
FIG. 2(A) (prior art) is a front view of a second embodiment of a conventional dam having an automatic collapsible means using a reservoir bucket, as viewed from the direction of a river being dammed.
Figure 2B:
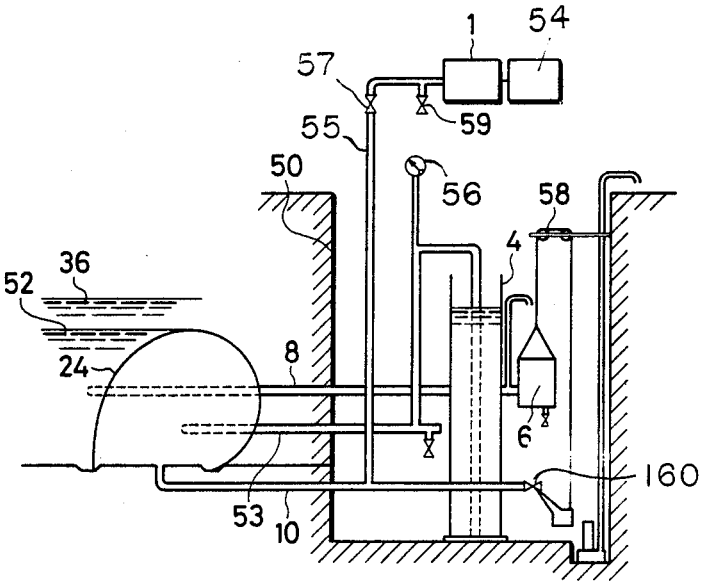
FIG. 2(B) PRIOR ART
FIG. 2(B) (prior art) is a cross-sectional view of the dam shown inFIG. 2A.
Figure 3A:
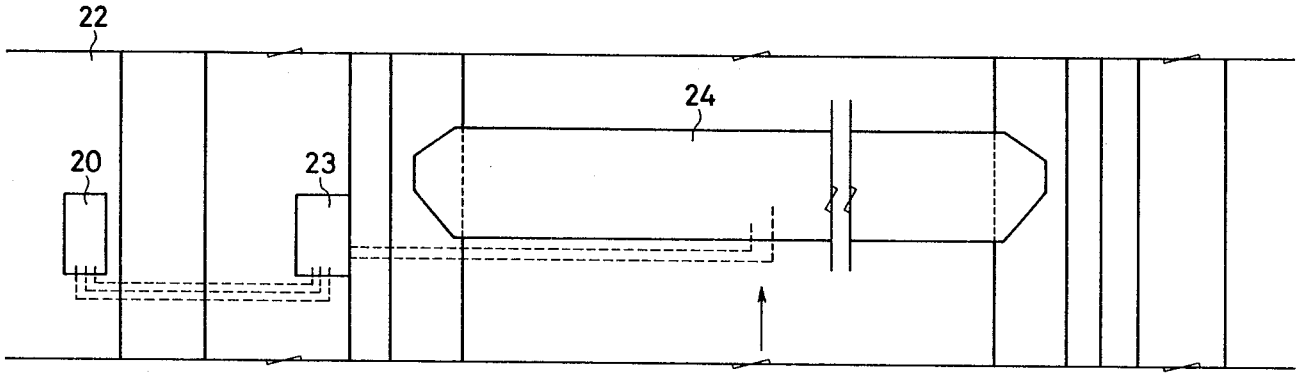
FIG. 3(A) is a plan view of the dam according to the present invention.
Figure 3B:
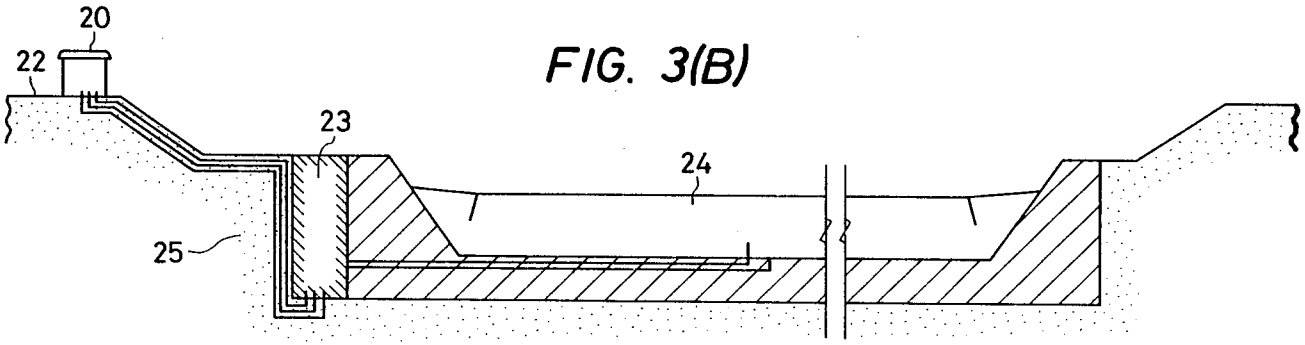
FIG. 3(B) is a sectional view of the dam shown in FIG. 3(A)

The presently preferred embodiment of the invention will now be further described with reference to FIGS. 3(A), 3(B) and 4. Reference numerals used in FIGS. 3(A), 3(B) and 4 that correspond to those used in prior art FIGS. 1(A), 1(B), 2(A) and 2(B) represent like or corresponding parts.

An upper control chamber 20 is positioned on an embankment 22 above an estimated high water level 21. A lower control chamber 23 is constructed separately and distinctly from upper control chamber. Lower control chamber 23 is positioned adjacent to weir 24 at an underground position 25. Underground position 25 can be on either the left or right bank of the river adjacent to weir 24.

Upper control chamber 20 includes a blower 1 which provides pressure for supporting the dam. Chamber 20 further includes a feed valve 2 and a pressure gauge 3 for sensing weir pressure. The overall function of upper chamber 20 is to control the supporting of the dam, i.e. maintaining it in its inflated state.

The functioning of chamber 20 for inflating the dam will now be described. Feed valve 2 is opened and blower 1 forces air into the interior of weir 24. Pressure gauge 3 can be read to determine when weir pressure reaches a desired setting. When weir pressure reaches a desired pressure level, blower 1 is stopped and feed valve 2 is closed to complete the inflating procedure and prevent air escape to maintain support control of the weir 24.

A safety device including a water seal pipe 4 is provided. Such a device is known and is described completely in Japanese Utility Model Publication No. 17075/73. The water seal pipe 4 discharges excess air when weir pressure becomes higher than a predetermined maximum permissible amount. That is, if the weir pressure becomes higher than the predetermined pressure due to an increase of water upstream of the weir 24, inner pressure of the weir 24 is supplied to the fluid in the water seal pipe 4. The weir 24 has an inner pressure which is equalized with the fluid pressure having a predetermined head.

Lower control chamber 23 includes a first exhaust valve 5 that is motor-controlled. Chamber 23 also includes a reservoir bucket 6 and an inverted U-shaped pipe 13 constituting a "collapsing means". When the collapsing means operates, air in weir 24 is initially discharged into lower control chamber 23.

The following describes how weir 24 is collapsed or flattened. A water gauge 7 is disposed upstream of the dam in the water course being damned. The water gauge 7 initially emits an electric signal to open electrically controlled motor valve 5 to discharge air from weir 24, thereby causing the dam to collapse.

When electric power fails, or when water gauge 7 or electrically controlled motor valve 5 is out of order, the bucket-type collapsible means is actuated to compensate therefor. The bucket-type collapsible means conducts river water through upper stream water level sensing pipeline 8 to reservoir bucket 6. A lever-type second exhaust valve 9 is opened via a wire rope or the like running from reservoir bucket 6 to valve 9.

The U-shaped pipe 13 has a horizontal section which is positioned at the emergency automatic collapse water level 39. If the water level exceeds the level 39, the water is introduced into the U-shaped pipe 13 and is discharged into the reservoir bucket 6. The movement of the bucket 6 permits the lever-type exhaust valve 9 to open to thereby discharge fluid from the weir 24 for its collapse.

A pipe arrangement 10 and 11 is provided between weir 24 and lower control chamber 23. This pipe arrangement 10 and 11 is horizontally led from the lower portion of weir 24 to lower control chamber 23 to automatically discharge the drain as well as the air accumulated in weir 24 and the pipe when the dam is collapsed.

The means for making the weir 24 self-supporting (also referred to as an "erection means") is disposed in upper control chamber 20 along with the safety device which is connected to feed and exhaust pipeline 10 and an excess pressure prevention pipeline 11. There is further provided piping 60, **60*a*, 60*b* and 60*c* between upper and lower control chambers 20 and 23, respectively. This piping 60–60*c* is laid shallow on the ground along the major bed and the slope of the embankment 22**.

Air discharged into lower control chamber 23 is exhausted by an exhaust pipe 12 which includes one end connected to lower control chamber 23 and the other end adapted to open in a position above the estimated high water level 21. Lower control chamber 23 is provided with a drain pump. The drain is exhausted when weir 24 is flattened and is discharged by a drain pipe (not shown) one end of which is coupled to the lower end of the chamber and which opens in a position above the estimated high water level 21.

Figure 4:
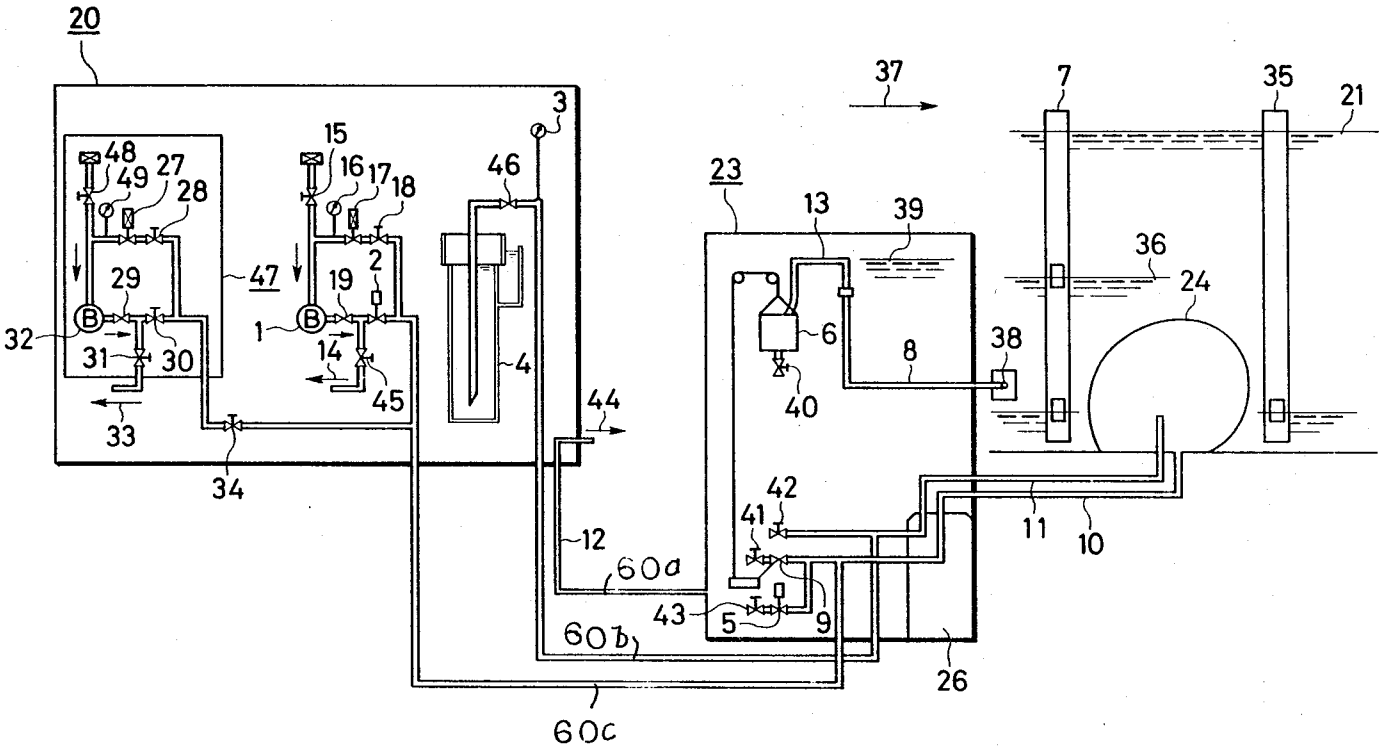
FIG. 4 is a schematic diagram of the control mechanisms shown only as general blocks in FIGS. 3A and 3B.

In FIG. 4, the upper chamber portion 20 also includes a manual feed valve 15 that is normally open, a vacuum gauge 16, a vacuum breaker valve 17, a manually forced exhaust valve 18 normally closed, a check valve 19, an exhaust air outlet, a forced exhaust manual valve 45 normally closed, a check valve 46, an emergency feed manual valve 48 normally open, an emergency vacuum gauge 49, and an inspection window 26.

Upper chamber portion 20 further includes an emergency vacuum breaker valve 27, an emergency force exhaust manual valve 28 normally closed, a check valve 29, an emergency feed manual valve 30, an emergency forced exhaust manual valve 31 normally closed, an engine-driven blower 32, and an emergency manual valve 34 normally closed. An exhaust is represented by arrow 33.

Outside of the control sections, there are located a level sensor 35 and a strainer 38 on an upstream water level sensor port. Arrow 37 denotes water flow direction and reference numeral 21 denotes a high water level. The automatic collapse level is marked by reference numeral 36. In lower chamber portion 23, there are located a reservoir bucket drain valve 40 and a valve 41 for regulating collapsed timing. There is also an emergency automatic collapse water level 39. Chamber portion 23 also includes a manual valve 42 and a valve 43 for regulating collapsed timing. An exhaust is represented by arrow 44.

According to the above-described structure, in order to provide an upstanding position of the weir 24, the feed valve 2 is opened and the blower 1 is actuated to supply air into the weir 24. If the inner pressure of the weir 24 reaches a predetermined pressure, the pressure gauge 3 detects the inner pressure of the weir 24. The feed valve 2 is closed and the blower 1 is deenergized so that weir inflation is completed. Incidentally, in case of the interruption of an electric supply, the emergency manual valve 34 and emergency feed manual valve 30 are opened so that the engine-driven blower 32 is operated to inflate the dam weir 24.

In order to collapse the weir 24, if the upstream water level reaches the automatic collapse level 36, the water level gauge 7 detects the water level, and air discharge electric valve 5 is opened to discharge air in the weir 24 towards the atmosphere. However, if electric power fails, upstream water is introduced into the bucket 6 through the upstream water level sensing strainer 38, upstream water level detection pipe 8 and the inverted U-shaped pipe 13, upon the upstream water level reaching the emergency automatic collapse water level 39. Because of the weight of the bucket 6 and water accumulated therein, the lever-type exhaust valve 9 is opened to discharge air in the weir 24 towards the atmosphere, so that the dam is collapsed. If the bucket 6 has descended, the bucket 6 should be lifted up for the next dam inflating operation. For this maneuver, water discharge valve 40 is opened to discharge water out of the bucket 6, and the lever-type discharge valve 9 is closed. The valves 41 and 43 for regulating collapsed timing control the air discharge amount in order to control the weir collapsing time.

Air in the weir 24 is completely discharged by the above-described automatic operation. However, in order to minimize the air discharge period (i.e. to increase the dam collapsing velocity), blowers 1 and 32 are used to forcibly discharge air from the weir 24. Operations of the blowers 1 and 32 are the same. (In the case of the blower 32, emergency manual valve 34 should be opened.) That is, the manually forced exhaust valve 18 and the emergency forced exhaust manual valve 28 are opened, and the manual feed valve 15 and the emergency feed manual valve 48, as well as forced exhaust manual valve 45 and emergency forced exhaust manual valve 31, are opened, and the blowers 1 and 32 are operated. As a result, air in the weir 24 can be forcibly discharged.

This forcible discharge is terminated by deenergizing the blowers 1 and 32 upon detection of the pressure decrease by the pressure gauge 3 and vacuum gauges 16 and 49. In this case, even if the operator forgets the deenergization of the blowers 1 and 32, the vacuum breaker valve 17 is actuated upon the inner weir pressure being not more than the predetermined level. Therefore, the extreme decrease of the inner pressure of the weir can be avoided. Furthermore, the check valve 46 is provided so as to prevent the water in the water seal pipe 4 from being sucked into the interior of the weir 24.

As an alternative, the invention may include a conventionally employed flow type collapse means other than the water level gauge, electric motor exhaust valve and the reservoir collapse means.

Other embodiments and modifications of the present invention will be apparent to those of ordinary skill in the art having the benefit of the teachings presented in the foregoing description and drawings. It is therefore to be understood that this invention is not to be unduly limited and such modifications are intended to be included within the scope of the appended claims.

We claim:

1. An inflatable and collapsible dam for selectively blocking the flow of a stream or river, comprising:

a flexible membrane weir element having a base and being positioned such that when it is inflated, it will block the flow of water;

an upper section control chamber, at least partially above ground, containing therein dam means for supporting the weir element;

a sealed lower section control chamber including therein a means for collapsing the weir element from a self-supported condition, said lower section being positioned lower in height than said upper section and being separated therefrom and at least partially underground;

a feed and exhaust pipeline connected to said weir element and adapted to discharge into said lower control chamber, said feed and exhaust pipeline being disposed horizontally at a level lower than that of the base of said weir element, said feed and exhaust pipeline also being provided at one end thereof with a first valve; and means, mounted in said lower control chamber, for collapsing said dam by opening said first valve.

2. A dam according to claim 1 wherein said upper control chamber is positioned at least in part above an estimated high water level.

3. An inflatable and collapsible dam according to claim 1, wherein said dam collapsing means includes:

means for generating an electrical signal in response to a first predetermined water level upstream of the dam;

electric motor means for opening said valve in response to said electric signal;

a second valve provided at said one end of said feed and exhaust pipeline; and second opening means for opening said second valve including an inverted U-shaped pipe in communication with water held upstream of the dam, a reservoir bucket, and pulley means for opening said second valve responsive to the weight of said reservoir bucket, said second opening means being actuatable only at a second predetermined water level upstream of the dam that is higher than said first predetermined water level.

4. An inflatable and collapsible dam according to claim 1, further comprising:

an exhaust pipe having a first and sealingly communicating with an interior of said lower section control chamber, and a second end communicating with an atmosphere external to said upper section control chamber, whereby air discharged into said lower section control chamber through said first valve may be exhausted from said chamber at an altitude that is above any possible water level upstream of the dam.

* * * * *